US010293471B2

(12) United States Patent
Wong

(10) Patent No.: US 10,293,471 B2
(45) Date of Patent: May 21, 2019

(54) ADAPTER FOR MULTIFUNCTIONAL ELECTRIC DRILL

(71) Applicant: ZHI LONG (H.K.) COMPANY LIMITED, Hong Kong (HK)

(72) Inventor: Kwok Hung Wong, Hong Kong (HK)

(73) Assignee: ZHI LONG (H.K.) COMPANY LIMITED, Hong Kong (HK)

( * ) Notice: Subject to any disclaimer, the term of this patent is extended or adjusted under 35 U.S.C. 154(b) by 0 days.

(21) Appl. No.: 14/894,368

(22) PCT Filed: Jul. 17, 2014

(86) PCT No.: PCT/CN2014/082396
§ 371 (c)(1),
(2) Date: Nov. 26, 2015

(87) PCT Pub. No.: WO2015/035828
PCT Pub. Date: Mar. 19, 2015

(65) Prior Publication Data

US 2016/0114471 A1 Apr. 28, 2016

(30) Foreign Application Priority Data

Sep. 13, 2013 (CN) ..... 2013 2 0570615 U

(51) Int. Cl.
*B25F 3/00* (2006.01)
*B25F 5/00* (2006.01)
*B25F 5/02* (2006.01)

(52) U.S. Cl.
CPC ..... *B25F 3/00* (2013.01); *B25F 5/026* (2013.01)

(58) Field of Classification Search
CPC ..... B23D 29/005; B23D 29/02; B23D 49/10; B23D 51/025; B23D 51/08; B23D 51/10;
(Continued)

(56) References Cited

U.S. PATENT DOCUMENTS 1,808,228 A * 6/1931 Hulack ..... B23D 49/162 30/500
1,898,956 A * 2/1933 Harvie ..... B23D 49/007 30/392
(Continued)

FOREIGN PATENT DOCUMENTS

CN 201124406 Y 10/2008
CN 101342694 B 2/2011
WO WO 2010020097 A1 * 2/2010 ..... B23D 67/04

OTHER PUBLICATIONS

International Search Report of PCT Patent Application No. PCT/CN2014/082396 dated Sep. 23, 2014.

*Primary Examiner* — Jason Daniel Prone

(57) ABSTRACT

The disclosure describes an adapter for a multifunctional electric drill which has a first bearing and a second bearing both disposed in an outer housing. By means of a transmission shaft disposed in the outer housing by using the first bearing and the second bearing, a swinging bearing mounted on the transmission shaft and a sliding rod connected to the swinging bearing, a preset angle is formed between the axis of the swinging bearing and the axis of the transmission shaft. A transmission shaft is fixed by using double bearings, rotation is stable, noise is low, and the service life is long; the rotation movement is converted into the straight reciprocating movement of a sliding rod by means of an inclined swinging bearing, and the energy conversion rate is high.

1 Claim, 8 Drawing Sheets

(58) Field of Classification Search
CPC ..... B23D 51/166; B25F 3/00; B26B 15/00; A61B 17/48
USPC ..... 30/228, 500, 125, 392–394; D8/70; D15/140
See application file for complete search history.

(56) References Cited

U.S. PATENT DOCUMENTS 2,319,973 A * 5/1943 Broderhausen .... B23D 57/0076 30/500
2,457,829 A * 1/1949 Miller ..... B23D 49/16 30/500
2,544,461 A * 3/1951 Leitzel ..... B23D 47/126 30/500
2,621,685 A * 12/1952 Butz ..... B23D 49/162 30/500
2,625,964 A * 1/1953 Green et al. ..... B23D 53/12 30/500
2,631,619 A * 3/1953 Folli ..... B23D 49/162 30/500
2,635,335 A * 4/1953 James ..... B23D 29/005 30/228
2,696,129 A * 12/1954 Riblet ..... B25H 1/0057 408/99
2,710,632 A * 6/1955 Richter, Jr. ..... B23D 49/007 30/500
2,714,905 A * 8/1955 Clayton ..... B23D 57/0076 30/500
2,760,265 A * 8/1956 Draenert ..... C14B 5/00 D8/70
2,787,265 A * 4/1957 Neidth ..... B23D 57/0076 30/500
2,793,661 A * 5/1957 Olson ..... B23D 49/165 30/500
2,822,005 A * 2/1958 Lee et al. ..... B23D 49/162 30/500
2,906,304 A * 9/1959 Levine ..... B23D 49/08 30/500
3,025,599 A * 3/1962 Sauers et al. ..... B23D 29/005 30/228
3,130,759 A * 4/1964 Mohr ..... B23D 49/162 144/35.1
3,260,289 A * 7/1966 Whitten, Jr. ..... B23D 49/162 30/392
3,585,719 A * 6/1971 Kivela ..... A01D 69/02 30/392
3,768,363 A * 10/1973 Tackett ..... B23C 1/20 30/500
4,173,069 A * 11/1979 Sidenstick ..... B23D 27/04 30/228
4,312,610 A * 1/1982 Burt ..... B23D 27/04 30/500
4,317,282 A * 3/1982 Pace ..... A01D 34/412 30/500
4,381,605 A * 5/1983 Holm ..... B23D 19/04 30/500
4,682,416 A * 7/1987 Stolfa ..... B23D 29/005 30/228
4,841,643 A * 6/1989 Colella ..... B23D 51/02 30/500
5,224,803 A * 7/1993 Lallier ..... B23B 45/003 30/500
5,239,758 A * 8/1993 Lindell ..... B23D 57/0076 30/500
5,371,947 A * 12/1994 Dickey ..... B23D 45/126 30/500
5,555,626 A * 9/1996 Fuchs ..... B23D 51/16 30/392
5,566,768 A * 10/1996 Bourke ..... B23D 49/162 30/500
5,595,250 A * 1/1997 Bourke ..... B23D 49/162 30/500
5,607,265 A * 3/1997 Lane ..... B23D 51/16 30/392
5,661,908 A * 9/1997 Chen ..... B23D 51/01 30/125
5,755,293 A * 5/1998 Bourke ..... B23D 49/162 30/500
5,901,447 A * 5/1999 Dunning ..... B26B 15/00 30/500
5,911,481 A * 6/1999 Yost ..... B23D 51/01 30/125
6,212,781 B1 * 4/2001 Marinkovich ..... B23D 51/16 30/394
6,234,255 B1 * 5/2001 Feldmann ..... B23D 49/162 30/394
6,264,211 B1 * 7/2001 Granado ..... B23D 57/0076 30/500
RE37,529 E * 1/2002 Bednar ..... B23D 49/162 30/392
6,434,836 B1 * 8/2002 Olivares ..... B26B 7/00 30/125
6,651,348 B1 * 11/2003 Steinmann ..... B23D 51/16 30/392
D487,386 S * 3/2004 Clivio ..... D8/70
D488,695 S * 4/2004 Peterson ..... D8/70
RE38,606 E * 10/2004 Bednar ..... B23D 49/162 30/392
6,820,339 B2 * 11/2004 Albrightson ..... B23D 49/11 30/500
D512,623 S * 12/2005 Huang ..... D8/70
D513,953 S * 1/2006 Peterson ..... B23D 29/00 D8/70
7,093,365 B2 * 8/2006 Peterson ..... B23D 29/00 30/500
7,096,590 B2 * 8/2006 Marinkovich ..... B23D 51/16 30/392
7,168,169 B2 * 1/2007 Moreno ..... B23D 51/16 30/394
D538,126 S * 3/2007 Aglassinger ..... D8/68
7,293,362 B2 * 11/2007 Konen ..... B23D 29/002 30/394
7,797,841 B2 * 9/2010 Moreno ..... B23D 51/16 30/392
7,891,101 B2 * 2/2011 Brady ..... B23D 45/003 30/500
8,205,342 B2 * 6/2012 Doumani ..... B23D 49/167 30/392
8,291,598 B2 * 10/2012 Corron ..... A47L 13/022 30/125
8,307,910 B2 * 11/2012 Holmes ..... B23D 49/165 30/393
8,381,832 B1 * 2/2013 Picard ..... B25F 3/00 30/500
8,407,901 B2 * 4/2013 Oberheim ..... B23D 49/16 30/393
8,789,283 B2 * 7/2014 Sinur ..... B23D 51/16 30/394
8,826,547 B2 * 9/2014 Oberheim ..... B23D 49/16 30/392
8,857,066 B2 * 10/2014 Haman ..... B23D 47/02 30/392
8,919,787 B1 * 12/2014 Wilcher ..... B23D 51/10 30/392
D730,141 S * 5/2015 Moss ..... D15/140
9,604,383 B1 * 3/2017 Wilcher ..... B26D 7/2614 30/500
2003/0051352 A1 * 3/2003 Clark, Jr. ..... B23D 49/11 30/392
2004/0035010 A1 * 2/2004 Kakiuchi ..... B23D 51/10 30/392
2005/0132583 A1 * 6/2005 Bednar ..... B23D 51/16 30/392
2006/0112566 A1 * 6/2006 Peterson ..... B23B 45/003 30/194
2010/0025059 A1 2/2010 Felger
2013/0213683 A1 * 8/2013 Brewster ..... B23Q 11/00 173/198

(56) References Cited

U.S. PATENT DOCUMENTS

| | | | | |
|---|---|---|---|---|
| 2014/0260831 | A1* | 9/2014 | Hays | B25B 23/0064 81/434 |
| 2016/0023289 | A1* | 1/2016 | Moss | B23D 29/005 30/500 |
| 2016/0271781 | A1* | 9/2016 | Kobayashi | B25F 3/00 30/500 |
| 2016/0375510 | A1* | 12/2016 | Batho | B23D 29/005 30/194 |

* cited by examiner

ADAPTER FOR MULTIFUNCTIONAL ELECTRIC DRILL

TECHNICAL FIELD

The present application relates to the technical field of electric tools manufacturing, and more particularly, relates to a multifunctional adapter connected to an electric drill.

BACKGROUND

At present, since the electric drill in the market is just used to clamp a drill head for drilling holes and openings on hard walls, its function is single. Adapters for an electric drill have already been reported. Patent document ZL200810021948.X has disclosed a multifunctional adapter for an electric drill comprising a gearing. The gearing comprises a rocking rod, a swing rod, a sliding rod and a chuck, which are successively connected. One end of the rocking rod is tightly inserted into a mounting hole on the drill head of the electric drill. The rotary movement of a motor shaft of the electric drill is converted to the linear reciprocating movement of the chuck through the gearing. Cutters mounted on the chuck can be saw blades, blades, files and the like to make the electric drill function as electric tools such as electric saws, electric files and the like. In this patent, the rotary movement of the electric drill is converted to the linear reciprocating movement through the rocking rod and the swing rod. One end of the rocking rod is a shaft connected to the mounting hole on the drill head of the electric drill, and the other end of the rocking rod is provided with an inclined plane with a connecting shaft. The upper end of the swing rod sheathes on the connecting shaft and the lower end of the swing rod is connected to the sliding rod. The rotation of the rocking rod is driven by the rotation of the electric drill. The circular rotation is converted into a cone-shaped rotation of the connecting shaft by the presence of the inclined plane. The upper end of the swing rod rotates relative to the connecting shaft, and the lower end is fixed on a straight line to swing from side to side, thus making the sliding rod move straightly and reciprocatingly. The connection between the rocking rod and the shell in the patent is realized by one bearing. Such that when the rocking rod is driven by the electric drill to rotate at a high speed, the irregular rotation of the inclined plane makes the conversion device shake a lot, which is inconvenient for operating. The joint between the inclined plane and the connecting shaft also suffers a great radial shear force and torque, so that it is easy to be broken after being used for a long time.

BRIEF SUMMARY

The present application is to provide a multifunctional electric drill adapter, aiming at the defects of the present single-function electric drill, such as having an adapter with bad balance and frangibility.

According to an aspect of present application, a multifunctional electric drill adapter is provided, which comprising an outer housing, a first bearing and a second bearing both disposed in the outer housing, a transmission shaft disposed in the outer housing via the first bearing and the second bearing, a swinging bearing mounted on the transmission shaft and a sliding rod connected to the swinging bearing, wherein a preset angle is formed between an axis of the swinging bearing and an axis of the transmission shaft.

Preferably, the preset angle between the axis of the swinging bearing and the axis of the transmission shaft is 5°~30°.

Preferably, the swinging bearing comprises an inner kit, a ball bearing, and an outer kit, wherein the inner kit detachably and fixedly sheathes outside the transmission shaft, a ball bearing hole is arranged on an outer surface of the inner kit, a ball bearing groove is arranged on an inner surface of the outer kit, and the sliding rod is connected to the outer kit through a connection part extending from an outer surface of the outer kit.

Preferably, a mounting hole is arranged on one end of the sliding rod, an end of the connection part is inserted inside the mounting hole, and the multifunctional electric drill adapter is detachably fixed to external tools through a connector arranged on the other end of the sliding rod.

Preferably, the external tool is one of the following tools: a saw blade, a scissor, a blade, a file, and a scraper.

Preferably, the external tool is a mowing saw blade including a first saw blade detachably fixed to the outer housing and a second saw blade detachably fixed to the connector arranged on the sliding rod.

Preferably, the external tool is a scissor including a first scissor blade detachably fixed to the outer housing and a second scissor blade detachably fixed to the connector, wherein the first scissor blade and the second scissor blade are rotatably connected to each other via a hinge.

Preferably, the external tool is a transverse saw blade comprising a transverse saw blade fixing part detachably fixed to the outer housing, a transmission gear fixing part detachably fixed to the outer housing, a transverse saw blade transmission rod limited to the transverse saw blade fixing part, a transmission gear rotatably fixed to the transmission gear fixing part, a metal saw blade fixed to the transverse saw blade transmission rod, wherein a reciprocating movement of the sliding rod is converted into a rotation movement of the transmission gear via a connection cover and the saw blade transmission rod is driven by the transmission gear to move straightly and reciprocatingly.

Preferably, at least one projection matching the mounting hole arranged on the sliding rod is arranged on the end of the connection part.

Preferably, the multifunctional electric drill adapter further comprises a U-shaped clip which is adjacent to the swinging bearing and clipped on the transmission shaft.

Preferably, the multifunctional electric drill adapter further comprises a bush detachably fixed on the outer housing, and the sliding rod is inserted inside a hollow cavity of the bush.

Preferably, the first bearing and the second bearing sheath outside the transmission shaft, and the first bearing and the second bearing are detachably fixed on the outer housing.

Preferably, the multifunctional electric drill adapter further comprises a handle with a placing position for placing the saw blade, the blade, the file, the scissor, and the scraper arranged inside the handle, wherein at least one handle mounting hole is arranged on the outer housing.

Preferably, the outer housing comprises an upper housing having a hollow cavity and a lower housing fixedly connected together through a screw, wherein the transmission shaft, the swinging bearing, and the sliding rod are arranged inside the hollow cavity.

Preferably, the multifunctional electric drill adapter further comprises a protecting shell.

When implementing the multifunctional electric drill adapter of the present application, the following advantageous effects can be achieved. A transmission shaft is fixed by using double bearings, so the rotation is stable, the noise is low, and the service life is long. As the rotation movement is converted into the straight reciprocating movement of a sliding rod via an inclined swinging bearing, the energy conversion rate is high.

BRIEF DESCRIPTION OF THE DRAWINGS

The present application will be further described with reference to the accompanying drawings and embodiments in the following, in the accompanying drawings.

DETAILED DESCRIPTION OF THE PREFERRED EMBODIMENT

To make the technical feature, objective and effect of the present application be understood more clearly, now the specific implementation of the present application is described in detail with reference to some of the accompanying drawings and embodiments. Based on the embodiments of the present application, all other embodiments obtained by the skilled person in the art by making no creative effort, are within the scope of the present application.

Figure 1:
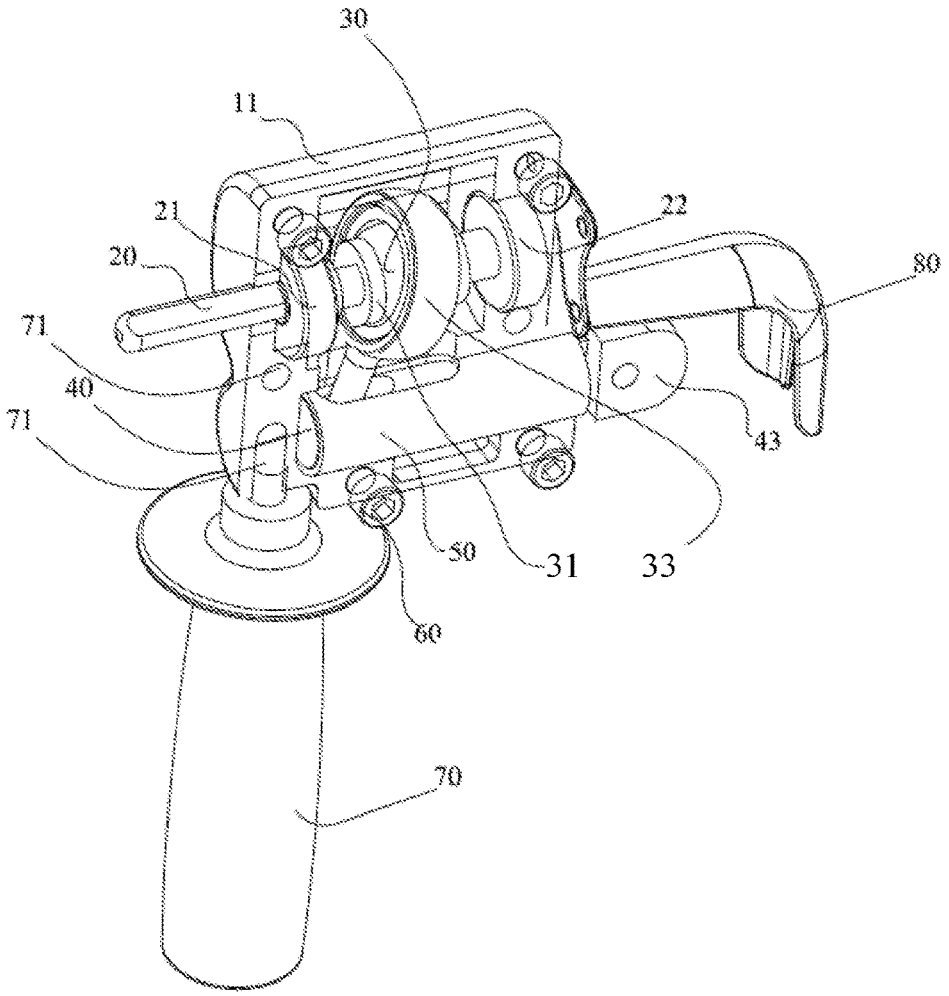
FIG. 1 is a structural diagram showing an inner structure of the multifunctional electric drill adapter according to the present application.

FIG. 1 shows an inner structure of a multifunctional electric drill adapter 100 according to the present application. The multifunctional electric drill adapter comprises an outer housing, a transmission shaft 20, a swinging bearing 30, and a sliding rod 40. The outer housing comprises an upper housing 11 and a lower housing (not shown) fixedly connected together through a screw. FIG. 1 shows a condition in which the screw 60 and the upper housing 11 are detached. As shown in FIG. 1, the transmission shaft 20, the swinging bearing 30 and the sliding rod 40 are all arranged inside a hollow cavity between the upper housing 11 and the lower housing 12.

Figure 2:
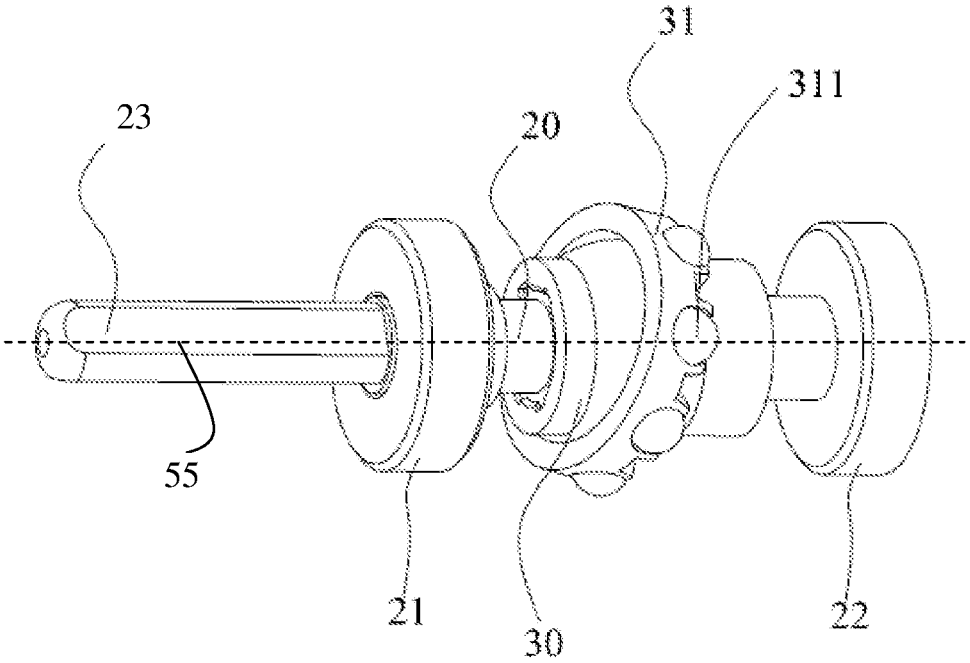
FIG. 2 is a structural diagram showing a connection between a transmission shaft and an inner kit of the multifunctional electric drill adapter according to the present application.

FIG. 2 shows a connection structure between the transmission shaft 20 and the inner kit 31 of the multifunctional electric drill adapter 100 according to the present application. The swinging bearing 30 is mounted on the transmission shaft 20. The swinging bearing 30 comprises an inner kit 31, a ball bearing (not shown) and an outer kit 33. The inner kit 31 fixedly sheathes outside the transmission shaft 20. The fixedly sheathed inner kit 31 and transmission shaft 20 can not be relatively rotated and slid. The concavo-convex coordination between the inner kit 31 and the transmission shaft 20 stops the relative rotation between the inner kit 31 and the transmission shaft 20. A U-shaped clip (not shown) clipped on the transmission shaft 20 stops the relative sliding movement between the inner kit 31 and the transmission shaft 20. The U-shaped clip is arranged between the inner kit 31 and the second bearing 22 and is adjacent to the inner kit 31, so as to prevent the inner kit 31 from sliding on the transmission shaft 20. A ball bearing hole 311 is arranged on an outer surface of the inner kit 31. A ball bearing groove 332 is arranged on an inner surface of the outer kit 33. When being rotated, the ball bearing greatly reduces friction between the inner kit 31 and the outer kit 33 to increase the efficient of power transmission, and to reduce noise. An upper end of the outer kit 33 is a ring shape with the ball bearing groove 332 arranged on. A straight connection part 331 is arranged on a lower end of the outer kit 33 which extends from the ring shape. A lower end of the connection part is connected to the sliding rod 40.

The rotation movement of the transmission shaft 20 is converted into straight reciprocating movement of the sliding rod 40 in the multifunctional electric drill adapter 100 of the present application. If according to a conventional bearing installation, the axis of the swinging bearing 30 is coincided with the axis of the transmission shaft 20, such that the straight connection part on the outer member 33 can not be swung from side to side. Therefore, in the present application, an angle between the central axis 55 of the swinging bearing 30 and the central axis 66 of the transmission shaft 20 is preset to be 5°~30°. In FIG. 1 it is 18°. By such set, the rotation of the transmission shaft 20 drives the connection part on the outer member 33 to swing from side to side, thus making the sliding rod 40 move straightly and reciprocatingly.

Figure 3:
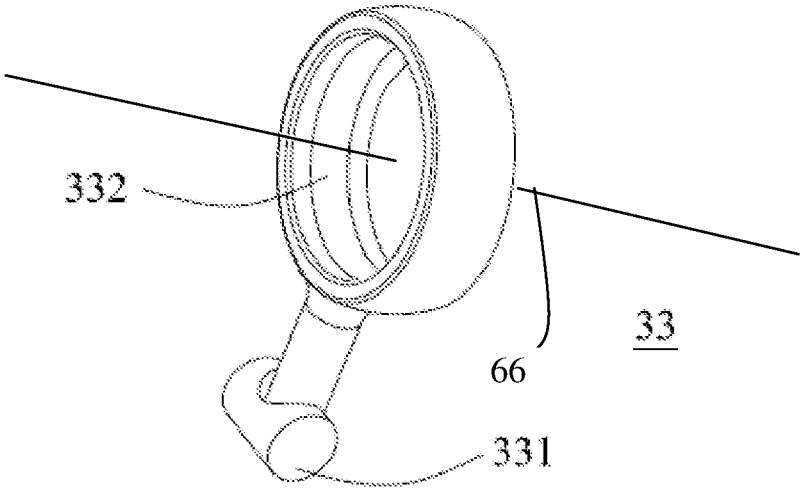
FIG. 3 is a structural diagram showing an outer kit of the multifunctional electric drill adapter according to the present application.
Figure 4:
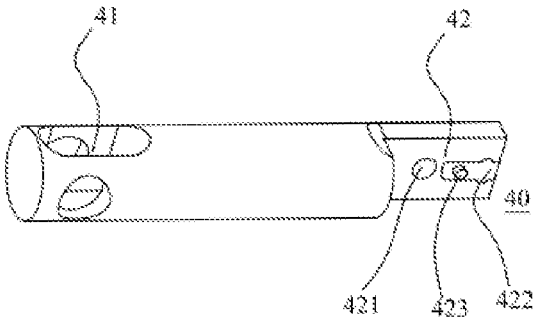
FIG. 4 is a structural diagram showing a sliding rod of the multifunctional electric drill adapter according to the first embodiment of the present application.

FIG. 3 shows a structure of the outer kit 33 in the multifunctional electric drill adapter 100 according to the present application. FIG. 4 shows the structure of the sliding rod in the multifunctional electric drill adapter 100 according to the first embodiment of the present application. As shown in FIG. 4, a mounting hole 41 arranged on one end of the sliding rod 40 is configured to connect the connection part of the outer kit 33 to the sliding rod 40. The mounting hole is a circular and straight hole. An end of the connection part is inserted inside the mounting hole. As shown in FIG. 3, at least one projection matching the mounting hole 41 is arranged on the end of the connection part 331. Thus the outer kit 33 can not be simply drawn out of the mounting hole so as to realize a more stable connection.

A connector 42 which is detachably fixed to external tools is arranged on the other end of the sliding rod 40. To make the multifunctional electric drill adapter 100 of the present application function in a greater range, an internal thread 421, a clip slot 422, and a set screw 423 are arranged on the connector 42. A connection cover 43 is detectably connected to the connector 42, and the connection cover 43 matches the connector 42. It should be noted that using the connection cover 43 and the connector 42 together can adapt the multifunctional electric drill adapter to external tools in the common market. These external tools are equipped with uniform standard connectors, for example, a connector has a shape matching the shape of the clip slot 422, and an opening matching the set screw 423. When this connector is clipped inside the clip slot 422, it can be fixed to the sliding rod 40 by screwing the set screw 423 and then fixing the connection cover 43 by the screw. Similarly, some external tools in the common market is equipped with a connector that is similar to the second saw blade fixing and mounting part 921 shown in FIG. 10. The width of the connector matches the width of the connection cover 43. After being mounted into the connection cover 43, the connector will not move up and down. The connector further comprises an opening matching the internal thread 421. A screw for fixing the connection cover 43 passes through the opening to make the connection cover 43 not move around, such that the connector is fixed to the sliding rod 40.

Figure 5:
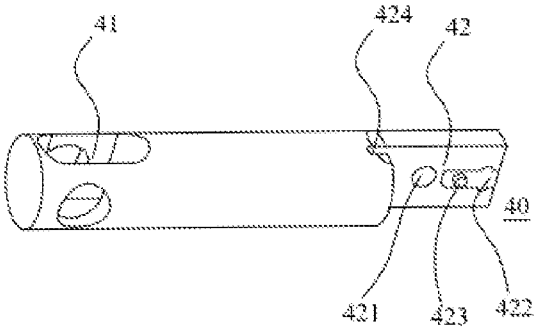
FIG. 5 is a structural diagram showing a sliding rod of the multifunctional electric drill adapter according to the second embodiment of the present application.

FIG. 5 shows the structure of the sliding rod in the multifunctional electric drill adapter according to the second embodiment of the present application. As shown in FIG. 5, a receiving groove 424 is arranged on one end of the connector 42 of the sliding rod 40. The receiving groove 424 is used to fasten a bump 436 arranged on the connection cover 43, so as to fix the connection cover 43 on the connector 42 more tightly.

Figure 6:
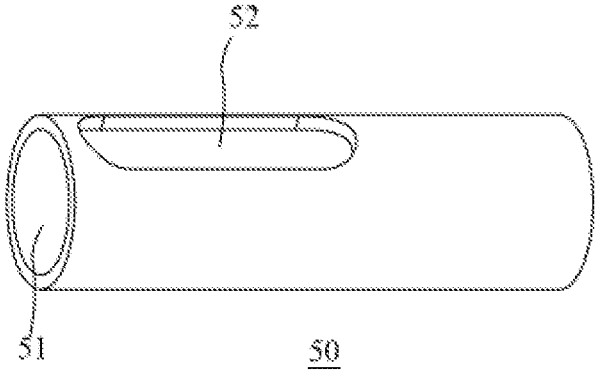
FIG. 6 is a structural diagram showing the bush of the multifunctional electric drill adapter according to the first embodiment of the present application.
Figure 7:
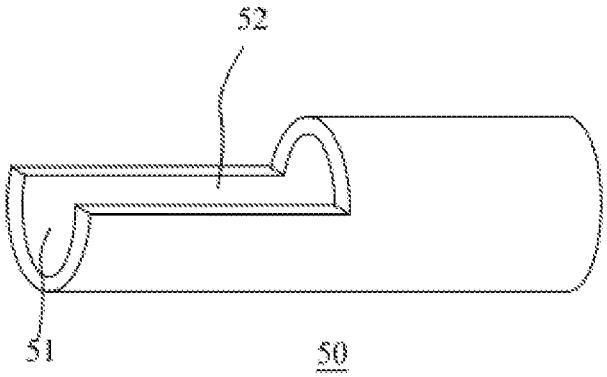
FIG. 7 is a structural diagram showing the bush of the multifunctional electric drill adapter according to the second embodiment of the present application.
Figure 8:
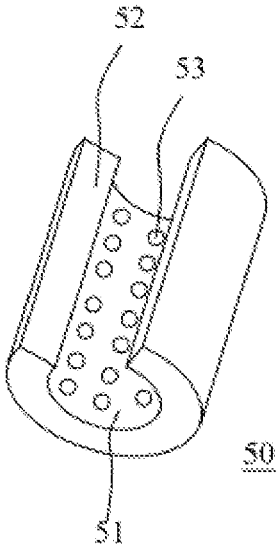
FIG. 8 is a structural diagram showing the bush of the multifunctional electric drill adapter according to the third embodiment of the present application.

FIG. 6-8 shows a structure of a bush 50 in the multifunctional electric drill adapter 100 according to the present application. The bush 50 is grossly in a cylindrical shape. The sliding rod 40 is mounted inside a hollow cavity 51 of the bush 50. Since the connection part 331 is passed through the bush 50 and connected to the sliding rod 40, a through-hole 52 is arranged on the bush 50. As shown in FIG. 6, the through-hole 52 is in an oval shape. As shown in FIG. 7, through-hole 52 is formed by cutting one piece from the columnar bush 50. Certainly, the through-hole 52 can be any shape which can be passed through by the sliding rod 40. The bush 50 needs to be wearable and its inner surface is polished to be clean to reduce the friction loss of the sliding rod 40 during the straight reciprocating movement. As shown in FIG. 8, preferably, a ball bearing mounting groove 53 is arranged on the inner surface of the bush 50. Some spherical ball bearings are placed inside the ball bearing mounting groove 53. The friction force between the sliding rod 40 and the bush 50 is reduced by using the ball bearings.

Figure 9:
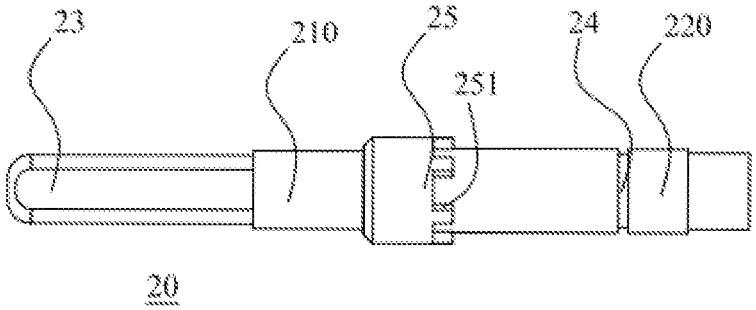
FIG. 9 is a structural diagram showing the transmission shaft of the multifunctional electric drill adapter according to the present application.

FIG. 9 shows the structure of the transmission shaft 20 in the multifunctional electric drill adapter 100 according to the present application. The transmission shaft 20 is connected to the outer housing via two bearings 21 and 22. A mounting groove is arranged on the outer housing to fix the two bearings. A first bearing fixing part 210, a second bearing fixing part 220, a U-shaped clip fixing groove 24 and an inner kit fixing part 25 are arranged on the transmission shaft 20. A concavo-convex part 251 is arranged on the inner kit fixing part 25 and is used to match the inner surface of the inner kit 31. One end of the transmission shaft 20 extending outside the outer housing is the electric drill connection part 23 used for fixing and clipping with the mounting hole on the electric drill head. The rotations of the transmission shaft 20 and other parts arranged on the transmission shaft 20 are driven by the rotation of the electric drill.

Figure 10:
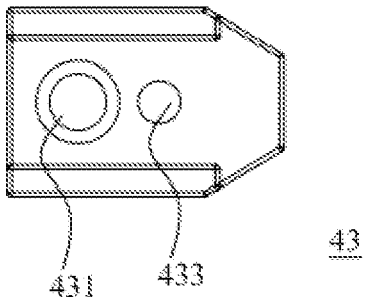
FIG. 10 is a structural diagram showing the connection cover of the multifunctional electric drill adapter according to the first embodiment of the present application.

FIG. 10 shows a connection cover 43, the shape of which matches the shape of the connector 42. An internal thread 431 matching the internal thread 421 is arranged on the connection cover 43. An internal thread 433 matching the set screw 423 is arranged on the connection cover 43. The internal thread 431 and the internal thread 433 are used to adapt common external tools in the common market. Since these external tools are equipped with uniform standard connectors, such as a saw blade 95, a blade, a file and a scraper, these external tools can move straightly and reciprocatingly by installing these external tools to the electric drill adapter 100 at any time.

Figure 11:
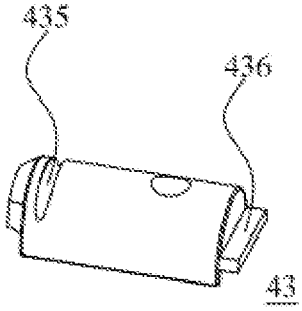
FIG. 11 is a structural diagram showing the connection cover of the multifunctional electric drill adapter according to the second embodiment of the present application.

FIG. 11 shows another connection cover 43 which matches the connector 42. Besides the internal thread 431 (not shown) and the internal thread 433 (not shown), a notch 435 and a bump 436 are also arranged on the connection cover 43. The notch 435 is used to match a connection clamp (shown in FIG. 12). The bump 436 is fastened inside the receiving groove 424 on the connector 42. The connection cover 43 is tightly fixed on the connector 42 via the connection clamp and the bump 436.

Figure 12:
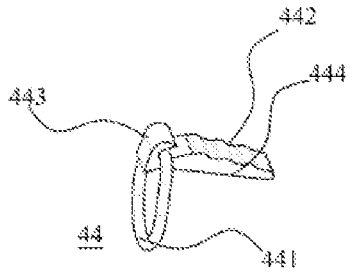
FIG. 12 is a structural diagram showing the connection clamp of the multifunctional electric drill adapter according to the present application.

FIG. 12 is a structural diagram showing a connection clamp of the multifunctional electric drill adapter according to the present application. As shown in FIG. 12, the connection clamp 44 comprises a clamping ring 441 and a rotatable fixing part 442. The clamping ring 441 is rotatably fixed on the rotatable fixing part 442. The rotatable fixing part 442 comprises a first holding surface 443 and a second holding surface 444. As the clamping ring 441 rotates around the rotatable fixing part 442, the distance between the top of the clamping ring 441 and the rotatable fixing part 442 changes. When the distance becomes lager, the connection clamp 44 can be detached or be mounted. When the distance becomes smaller, a clamping force is formed and the connection clamp 44 is clamped.

Figure 13:
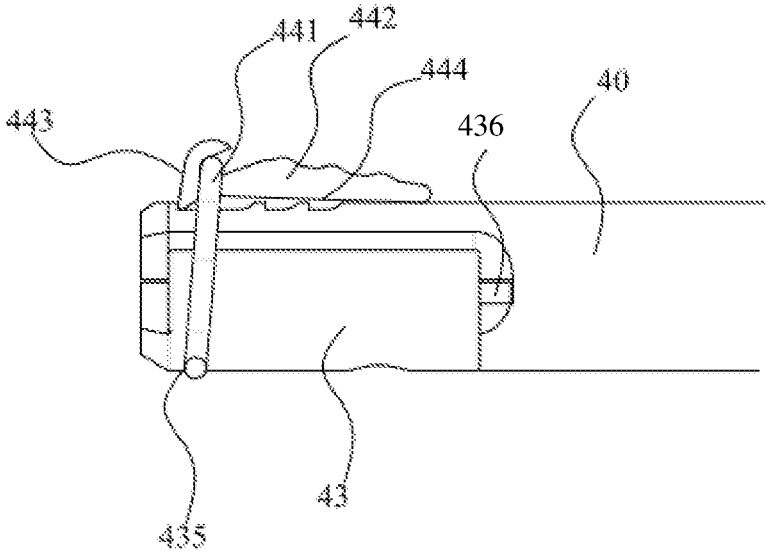
FIG. 13 is a structural diagram showing the clamping between the connection clamp, the sliding rod and the connection cover of the multifunctional electric drill adapter according to the present application.

FIG. 13 is a structural diagram showing the clamping between the connection clamp, the sliding rod and the connection cover of the multifunctional electric drill adapter according to the present application. As shown in FIG. 13, before the connection clamp clamps the sliding rod and the connection cover, the clamping ring 441 is rotated to make the distance between the top of the clamping ring 441 and the rotatable fixing part 442 be the largest one, then the first holding surface 443 contacts the outer surface of the connection cover 43. The connection clamp 44 slides along the outer surface of the connection cover 43 until the clamping ring 441 falls into the notch 435, and then the clamping ring 441 is fixed. The rotatable fixing part 442 is rotated by the external force to generate a clamping force, which enable the connection cover 43 to be fixed to the connector 42 more tightly.

The rotatable fixing part 442 is rotated by the external force. During this process, as the distance between the top of the clamping ring 441 and the rotatable fixing part 442 becomes smaller, the clamping force becomes larger, thus making the connection cover 43 be fixed to the connector 42 more tightly.

Figure 14:
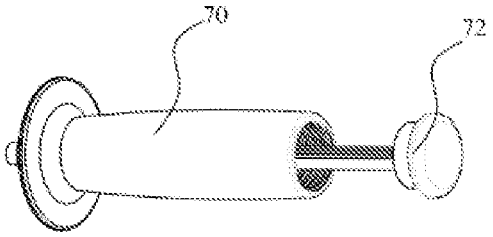
FIG. 14 is a structural diagram showing the handle of the multifunctional electric drill adapter according to a preferred embodiment of the present application.

FIG. 14 is a structural diagram showing the handle of the multifunctional electric drill adapter according to a preferred embodiment of the present application. As shown in FIG. 14, the multifunctional electric drill adapter 100 of the present application further comprises a handle 70. At least one handle mounting hole 71 is arranged on the outer housing, and preferably three handle mounting holes 71 are arranged on the left side, the right side and the lower side of the outer housing to achieve a left hand gripping, a right hand grip gripping and a lower side gripping. Preferably, the handle 70 is in a hollow shape and a placing position for placing the saw blade, the blade, the file, the scissor, and the scraper is arranged inside the handle. The above tools are sealed inside the handle 70 via a handle cover 72. When using the tools, users just need to open the handle cover for facilitating carry.

Figure 15:
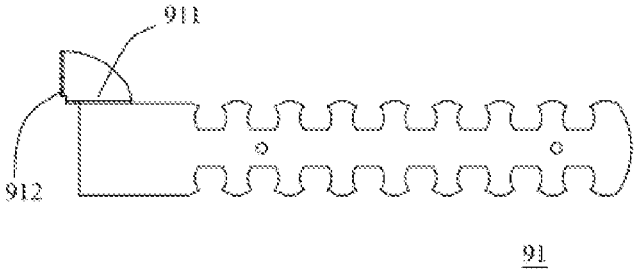
FIG. 15 is a structural diagram showing the first saw blade of the multifunctional electric drill adapter according to the first preferred embodiment of the present application.
Figure 16:
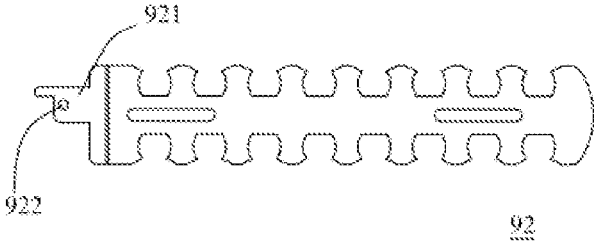
FIG. 16 is a structural diagram showing the second saw blade of the multifunctional electric drill adapter according to the first preferred embodiment of the present application.

FIGS. 15 and 16 show a structure of a mowing saw blade 90 of the multifunctional electric drill adapter 100 according to the present application. The mowing saw blade comprises a first saw blade 91 and a second saw blade 92. A first saw blade fixing and mounting part 911 is arranged on the first saw blade 91 and a first saw blade fixing and mounting hole 912 is arranged on the first saw blade fixing and mounting part 911. An internal thread hole matching the first saw blade fixing and mounting hole 912 is arranged on the outer housing, and the first saw blade 91 is fixed on the outer housing by the screw. A second saw blade fixing and mounting part 921 is arranged on the second saw blade 92, and a second saw blade fixing and mounting hole 922 is arranged on the second saw blade fixing and mounting part 921. The second saw blade fixing and mounting hole 922 matches the internal thread 421 on the connector 42 and the internal thread 431 on the connection cover 43. The second saw blade 92 is fixed on the sliding rod 40 by a through connection of the screw. The connection cover 43 impacts the connector 42. By the above fixing ways, the first saw blade 91 and the second saw blade 92 are disposed vertically in different rows. When being used, the first saw blade 91 is fixed and the second saw blade 92 follows the sliding rod 40 to do a left-right reciprocating movement, which makes the cutting port of the first saw blade 91 match the cutting port of the second saw blade 92 to cut the grass falling into the cutting port. Preferably, the first saw blade 91 and the second saw blade 92 are disposed vertically in different rows by the screw, and at least two screw mounting holes are arranged both on the first saw blade 91 and the second saw blade 92. Since the second saw blade 92 needs to follow the sliding rod 40 to do a left-right reciprocating movement, the screw mounting hole of the second saw blade 92 is in a shape of long strip. Of course, in order to make the first saw blade 91 and the second saw blade 92 which are disposed vertically in different rows be more stably during the relative movement, a long baffle plate is preferably disposed on one side of the second saw blade 92 opposite the first saw blade 91. The long baffle plate can cover all the screw mounting holes on the second saw blade 92. The first saw blade 91 and the second saw blade 92 are disposed vertically in different rows by the screw and the long baffle plate.

The multifunctional electric drill adapter of the present application further comprises a protecting shell 80. As shown in FIG. 1, the protecting shell 80 is fixed to the outer housing through a screw. A recessed notch is arranged on the protecting shell 80. One end of the external tools is connected to the connector 42, and the other end is inserted into the recessed notch on the protecting shell 80. The protecting shell 80 is configured to prevent small items such as saw dust generated by the use of external tools, such as saw blades, from flowing in all direction.

Figure 17:
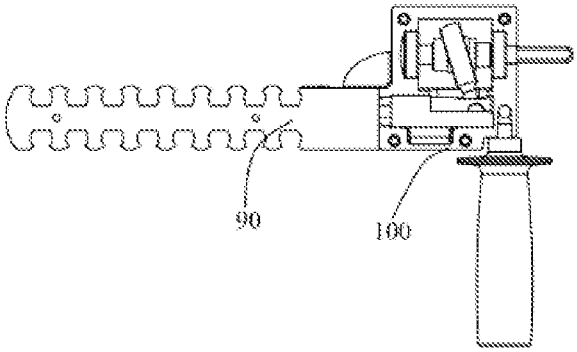
FIG. 17 is a structural diagram showing the multifunctional electric drill adapter according to the first preferred embodiment of the present application.

FIG. 17 shows the multifunctional electric drill adapter 100 according to a first preferred embodiment of the application. As shown in FIG. 17, a mowing saw blade 90 is mounted to the multifunctional electric drill adapter 100 to function as a mower. The second saw blade fixing and mounting hole 922 of the mowing saw blade 90 matches the internal thread 421 on the connector 42 and the internal thread 431 on the connection cover 43. The second saw blade 92 is fixed to the sliding rod 40 by a through connection of the screw and making the connection cover 43 compressing the connector 42. The first saw blade 91 is fixed to the first saw blade fixing and mounting hole 912 on the outer housing via a screw to make the first saw blade 91 and the second saw blade 92 be disposed vertically in different rows.

Figure 18:
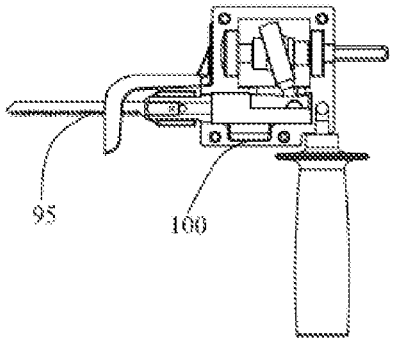
FIG. 18 is a structural diagram showing the multifunctional electric drill adapter according to the second preferred embodiment of the present application.

FIG. 18 shows the multifunctional electric drill adapter 100 according to a second preferred embodiment of the application. In which the multifunctional electric drill adapter 100 is connected to a common metal saw blade 95 sold in the market. Then the multifunctional electric drill adapter 100 is connected to an electric drill to function as an electric saw.

Figure 19:
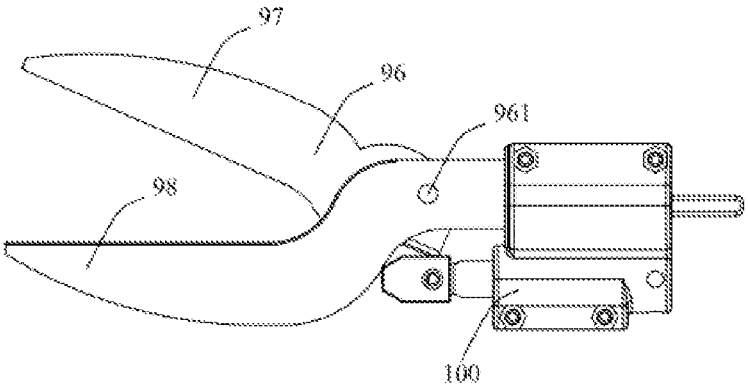
FIG. 19 is a structural diagram showing the multifunctional electric drill adapter according to the third preferred embodiment of the present application.

FIG. 19 shows the multifunctional electric drill adapter 100 according to a third preferred embodiment of the application. As shown in FIG. 19, a scissor 96 is mounted to the multifunctional electric drill adapter 100 to function as an automatic scissor. A second scissor blade fixing and mounting part and a second scissor blade fixing and mounting hole (not shown) are arranged on the second scissor blade 97 of the scissor 96. The second scissor blade fixing and mounting part is similar to the second saw blade fixing and mounting part 921 of the mowing saw blade 90, and the second scissor blade fixing and mounting hole is similar with the second saw blade fixing and mounting hole 922 of the mowing saw blade 90. The second scissor blade fixing and mounting part and the second scissor blade fixing and mounting hole are mounted to the multifunctional electric drill adapter 100 via the connector 42 and the connection cover 43 to make the second scissor blade move reciprocatingly along with the sliding rod 40. The first scissor blade 98 is similar to the first saw blade of the mowing saw blade 90. The first scissor blade mounting part arranged on the first scissor blade 98 is connected to the outer housing of the multifunctional electric drill adapter 100 via a screw to fix the first scissor blade 98. The second scissor blade 97 is rotatably connected to the first scissor blade 98 via the hinge 961. The straight reciprocating movement of the second scissor blade 97 is converted into the open and close movement of the scissor 96 along the hinge 961 to realize relative functions such as mowing etc.

Figure 20:
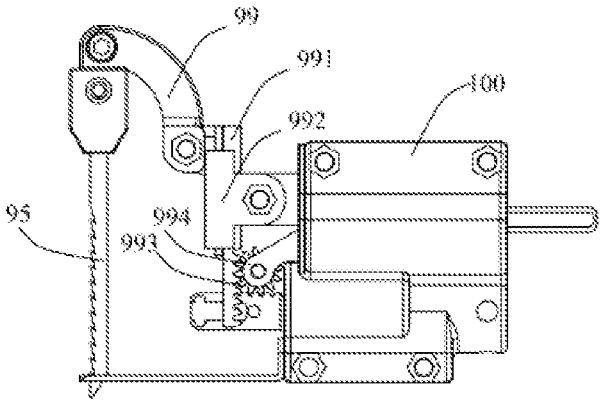
FIG. 20 is a structural diagram showing the multifunctional electric drill adapter according to the fourth preferred embodiment of the present application.

FIG. 20 is the multifunctional electric drill adapter 100 according to a fourth preferred embodiment of the application. As shown in FIG. 20, a transverse saw blade 99 is mounted to the multifunctional electric drill adapter 100 to function as an automatic transverse saw blade. The transverse saw blade 99 comprises a transverse saw blade transmission rod 991, a transverse saw blade fixing part 992, a transmission gear 993, a transmission gear fixing part 994, and a metal saw blade 95. The transverse saw blade fixing part 992 and the transmission gear fixing part 994 are fixed to the outer housing of the multifunctional electric drill adapter 100 via a screw. A receiving groove configured to receive the transverse saw blade transmission rod 991 is arranged on the transverse saw blade fixing part 992 to make the transverse saw blade transmission rod 991 move reciprocatingly along the receiving groove. An indentation is arranged on the saw blade transmission rod 991. The transmission gear 993 is fixed on the transmission gear fixing part 994. The transmission gear 993 is engaged with the indentation on the saw blade transmission rod 991. The saw blade transmission rod 991 is driven by the rotation of the transmission gear 993. The transmission gear 993 is engaged with both the saw blade transmission rod 991 and the connection cover 43. An indentation is also arranged on the connection cover 43. The connection cover 43 is fixed to the sliding rod 40 and moves reciprocatingly along the sliding rod 40. The straight reciprocating movement is converted into the rotation movement of the transmission gear 993, and the rotation movement of the transmission gear 993 is converted into the straight reciprocating movement of the saw blade transmission rod 991 through the saw blade transmission rod 991. A metal saw blade 95 is detachably fixed at the end of the saw blade transmission rod 991. After completing the above connections, the multifunctional electric drill adapter 100 of the present application is connected to an electric drill to work as a transverse saw. The movement direction of the metal saw blade 95 can be perpendicular to the movement direction of the sliding rod 40 (as shown in FIG. 20). A preset angle between the movement direction of the metal saw blade 95 and the movement direction of the sliding rod 40 can be formed by transverse saw blade fixing part 992 with different shapes.

By implementing the multifunctional electric drill adapter of the present application, the rotation movement is converted into the straight reciprocating movement of a sliding rod by means of an inclined swinging bearing, and the energy conversion rate is high. External tools such as the above mowing saw blade 90, the metal saw blade 95, the scissor 96 and the transverse saw blade 99 etc. are connected to the adapter through the uniform connector. The functions of the external tools are realized by the fast rotation of the electric drill. Besides, the electric drill is easy to be detachable and convenience to be carried, and can be used in many places.

The invention claimed is:

1. An automatic transverse saw blade comprising a multifunctional electric drill adapter and an external tool, wherein the multifunctional electric drill adapter comprises:

an outer housing, a first bearing and a second bearing both disposed in the outer housing, a transmission shaft disposed in the outer housing via the first bearing and the second bearing, a swinging bearing mounted on the transmission shaft and a sliding rod connected to the swinging bearing;

the swinging bearing comprises an inner member, a ball bearing, and an outer member; wherein, the inner member fixedly sheathes outside the transmission shaft, a ball bearing hole is arranged on an outer surface of the inner member, a ball bearing groove is arranged on an inner surface of the outer member; and a connection part is extending from an outer surface of the outer member;

wherein, a mounting hole is arranged on one end of the sliding rod, an end of the connection part of the outer member is inserted inside the mounting hole, a connector is arranged on the other end of the sliding rod, wherein the connector has a connection cover arranged with indentations fixed to the sliding rod;

wherein the external tool is a transverse saw blade assembly comprising a transverse saw blade fixing part, a transmission gear fixing part, a transverse saw blade transmission rod whose position is restricted by the transverse saw blade fixing part, a transmission gear rotatably fixed to the transmission gear fixing part, a metal saw blade fixed to the transverse saw blade transmission rod, wherein the transmission gear is engaged with both the transverse saw blade transmission rod and the connection cover which moves reciprocatingly along the sliding rod, such that a straight reciprocating movement of the sliding rod is converted into the rotation movement of the transmission gear via the connection cover, wherein the saw blade transmission rod is driven by the transmission gear to move straightly and reciprocatingly.

* * * * *